US006057777A

United States Patent [19]

Dunne et al.

[11] Patent Number: 6,057,777

[45] Date of Patent: May 2, 2000

[54] INDUSTRIAL POSITION SENSOR

[75] Inventors: Jeremy G. Dunne, Littleton; Patrick J. Delohery, Castle Rock, both of Colo.

[73] Assignee: Laser Technology, Englewood, Colo.

[21] Appl. No.: 08/903,904

[22] Filed: Jul. 31, 1997

[51] Int. Cl.[7] ..... G08B 21/00

[52] U.S. Cl. ..... 340/686.1; 212/276; 340/436; 340/685

[58] Field of Search ..... 340/686.1, 686.2, 340/686.3, 686.4, 686.5, 686.6, 685, 436; 212/276; 414/273

[56] References Cited

U.S. PATENT DOCUMENTS

| | | | |
|---|---|---|---|
| 2,181,778 | 11/1939 | Ball | 212/276 |
| 4,030,088 | 6/1977 | McCullough | 340/267 |
| 4,216,868 | 8/1980 | Geppert | 340/685 |
| 4,286,911 | 9/1981 | Benjamin | 414/273 |
| 4,551,722 | 11/1985 | Tsuda et al. | 340/904 |
| 4,644,237 | 2/1987 | Frushour et al. | 318/313 |
| 5,235,315 | 8/1993 | Cherry et al. | 340/436 |
| 5,343,739 | 9/1994 | Curry | 212/276 |
| 5,481,248 | 1/1996 | Kruh | 212/276 |
| 5,515,448 | 5/1996 | Nishitant | 340/436 |
| 5,634,565 | 6/1997 | Lesage | 212/276 |

*Primary Examiner*—Jeffery A. Hofsass
*Assistant Examiner*—John Tweel, Jr.
*Attorney, Agent, or Firm*—Stuart T. Langley; William J. Kubida; Hogan & Hartson LLP

[57] ABSTRACT

A sensor for determining the position of a movable object along a selected axis. The system includes a target positioned at a location aligned with the selected axis. An optical energy emitter is mounted on the movable object and has a beam dispersion greater than two degrees directed at the target. An optical energy receiver is mounted on the movable object and aligned to receive optical energy reflected by the target. The optical energy detector generates a receive signal indicating reception of the optical energy. A time of flight circuit coupled to the emitter and receiver generates a flight time signal indicating the elapsed time from emission of the optical energy to reception of reflected optical energy. A control circuit monitors the flight time signal and outputs a position signal indicating position of the movable object with respect to the target.

6 Claims, 8 Drawing Sheets

INDUSTRIAL POSITION SENSOR

BACKGROUND OF THE INVENTION

1. Field of the Invention

The present invention relates, in general, to industrial machine control, and, more particularly, to a system and method for sensing position of an overhead crane for process automation and collision avoidance.

2. Relevant Background

Motorized vehicles are commonly used in industrial environments such as manufacturing facilities, assembly facilities, and warehouses. For example, an industrial facility may include one or more overhead cranes that are used to transport heavy items or materials from one location to another.

A typical overhead crane includes a pair of rails spanning a distance across the facility and a bridge that spans the rails. The bridge is motorized to move along an axis defined by the rails and may include a tram that moves along the bridge between the rails. The tram may be controlled manually through a control box that is coupled by wires or radio control device. Alternatively, an automated factory uses programmable computers to control and coordinate the actions of various pieces of machinery in the factory.

With either manual or automated control, it is important to track the position of the motorized vehicle with accuracy and precision. To ease manual control and enable automated control, position information is required to pick up and deliver payloads as required. Moreover, overhead cranes are relied on to move heavy loads quickly but to minimize swinging and pendulum action of the load as the crane stops and starts. Hence, the crane must speed up and slow down based upon knowledge of its current position and the desired destination.

A further use of position information is to avoid collisions between the motorized vehicle and other objects such as factory walls or other motorized vehicles operating in the same work space. Collision avoidance is readily implemented if reliable, precise position information is available for all of the motorized equipment in a factory.

Prior position sensing equipment used ultrasonic or radio frequency devices (i.e., RADAR). Ultrasonic devices are subject to multiple echoes and reflections in an industrial environment. These echoes and reflections make it difficult to obtain accurate and reliable position information. Radio frequency systems exhibit fewer problems with reflections and echoes, but are susceptible to radio frequency interference (RFI). RFI is a significant noise problem in an industrial environment in which large, high speed motors and welding equipment, for example, are in use. What is needed is an industrial position sensor that is immune to echoes, undesired reflections, and RFI.

Because of their accuracy and RFI noise immunity, there have been attempts to use lasers for position sensing equipment. Such systems mount a laser and a photodetector on the motorized equipment. Both the laser and photodetector are initially aligned to a reference object positioned along the axis of travel for the motorized equipment. To sense position, the laser is activated and the photodetector generates a signal from the energy reflected by the reference object. The time between LASER activation and reception of the reflected signal is measured and indicates distance between the motorized vehicle and the reference object. The reference object may be fixed or movable depending on whether fixed or relative position information is desired.

Unfortunately, laser devices capable of sufficient power output to work as position sensors are costly. Also, lasers output a characteristically narrow beam that does not diverge significantly as it travels through space. While non-divergence is a desirable property from a power efficiency standpoint, it makes alignment of a laser with a reference object problematic. Moreover, industrial cranes, for example, may bend slightly in the middle of their span when carrying heavy loads. This bending can cause a position sensor mounted on the motorized vehicle to skew several degrees from its position at the ends of the span. This skewing is not a problem for ultrasonic or radio frequency position sensors that use wide beam width signals for sensing. However, the narrow beam width of lasers results in failure of the laser beam to reach the reference object and/or successfully reflect back to the position sensor for a measurement. A need remains for an industrial position sensor with noise immunity and precision similar to laser systems but that is easily aligned and immune to misalignment caused by crane skewing.

SUMMARY OF THE INVENTION

Briefly stated, the present invention involves a sensor for determining the position of a movable object along a selected axis. The system includes a target positioned at a location aligned with the selected axis. An optical energy emitter is mounted on the movable object and has a beam dispersion greater than two degrees directed at the target. An optical energy receiver is mounted on the movable object and aligned to receive optical energy reflected by the target. The optical energy detector generates a receive signal indicating reception of the optical energy. A time of flight circuit coupled to the emitter and receiver generates a flight time signal indicating the elapsed time from emission of the optical energy to reception of reflected optical energy. A control circuit monitors the flight time signal and outputs a position signal indicating position of the movable object with respect to the target.

In another aspect, the present invention involves a method for operating a spatial positioning system for determining the linear position of a movable object along a selected axis. A reflective target is mounted at a location on the selected axis and an optical energy emitter is adjustably mounted on the movable target. An optical energy receiver is adjustably mounted on the movable object and the emitter and receiver are coarsely aligned with the target. The power received by the optical energy receiver is monitored while adjusting the alignment. The emitter and receiver are rigidly affixed to the movable object when the power received is above a preselected threshold.

In still another aspect, the present invention involves a precision digital-to-analog converter driving the output of a spatial positioning system. A first pulse width modulation (PWM) generator generates a first N-bit PWM signal on an output. A second PWM generator generates a second M-bit PWM signal on an output. A first resistor has a first end coupled to the output of the first PWM generator. A second resistor has a first end coupled to the output of the second PWM generator. The first and second resistor are chosen such that a ratio of the first resistor to the second resistor is $1:2^N$. A summing node couples the second ends of the first and second resistors. A low pass filter removes the high frequency components from the combined PWM signal to generate an analog output.

DETAILED DESCRIPTION OF THE PREFERRED EMBODIMENTS

The need for position sensors for motorized vehicles in industry is well accepted. Because motorized vehicles carry heavy and bulky loads, safety is a significant concern. Hence, many of the features of the present invention are directed to safe operation of the position sensor in accordance with the present invention. Likewise, accuracy and precision in reporting position are critical to safe and efficient operation. Accordingly, several features of the present invention improve accuracy, precision and robustness of the position sensor in accordance with the present invention.

The present invention has particular utility as a position sensor for overhead cranes. However, it is easily adapted to operate as a position sensor in any environment where travel of a motorized vehicle is confined. The invention is particularly suitable where motion is confined to one axis such as overhead cranes, elevators, lifts, rail vehicles, and the like. Hence, while the present invention is described herein in terms of a position sensor for overhead cranes, the teachings of the present invention are easily adapted for use on these other types of vehicles and they are equivalent to the specific implementation disclosed herein for purposes of the present invention.

Figure 1A:
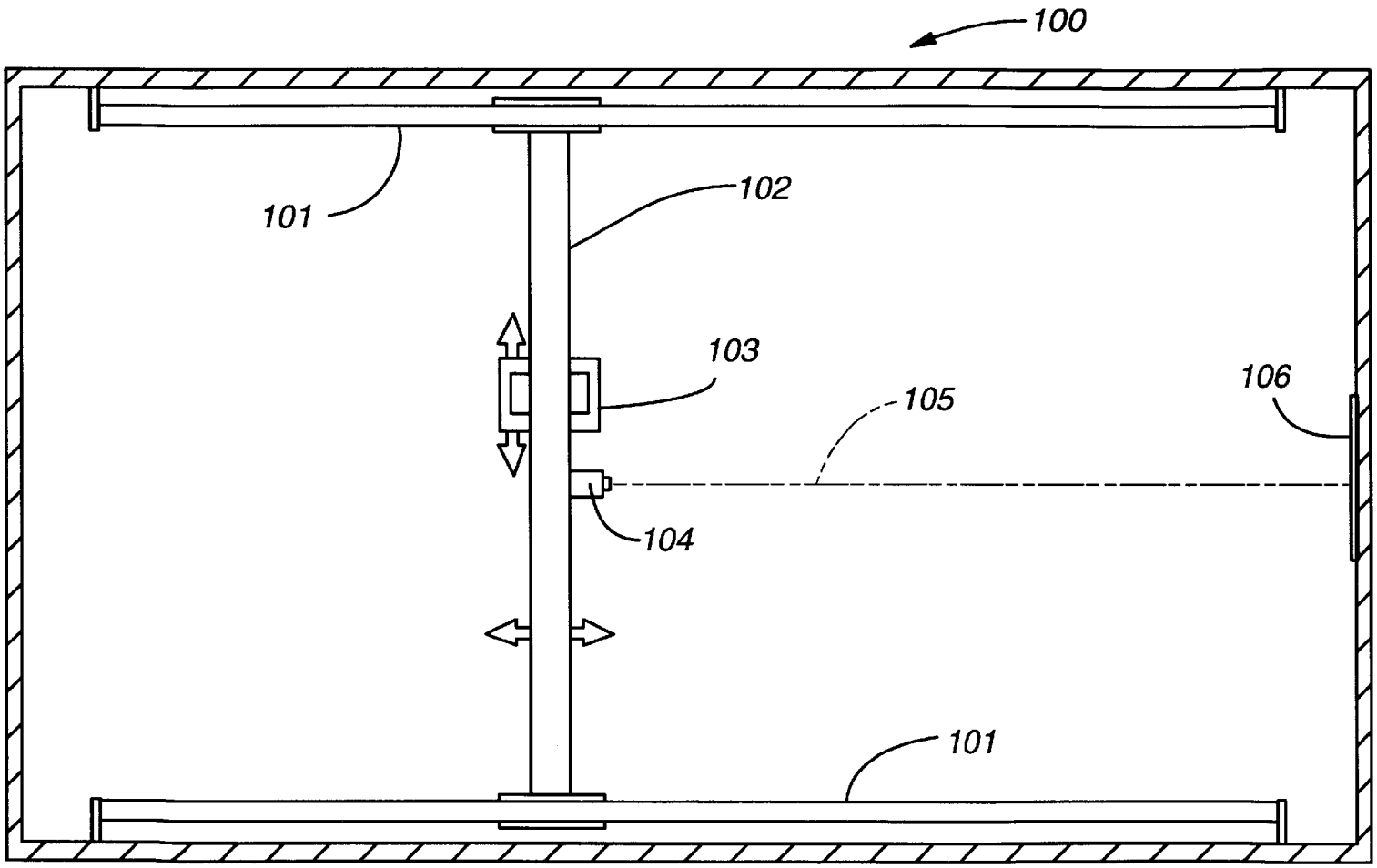
FIG. 1*a* shows a schematic illustration of a top-down view of an overhead crane using the position sensor in accordance with the present invention.

FIG. 1*a* illustrates an overhead crane system 100 comprising a pair of rails 101 supporting a single tram 103 mounted on a bridge 102. Bridge 102 travels back and forth along the span of rails 101 as suggested by the horizontal arrows in FIG. 1*a*. Tram 103 also moves back and forth along the span of bridge 102 as suggested by the vertical arrows in FIG. 1*a*. The motions of bridge 102 and tram 103 are controlled by a wire or pendent (not shown) reaching down to an operator on the factory floor, or through a radio control system (not shown) in a well known manner.

In most cases, bridge 102 and tram 103 move at variable rates depending on the load that is being carried and the distance that must be traveled, among other factors. To change the speed of the motors driving bridge 102 and tram 103, it is important to know their position within a few inches. If more than a few inches of inaccuracy exists, it becomes necessary to manipulate bridge 102 and tram 103 with a plurality of fine manual adjustments to accurately position a load (not shown). Also, to make full use of the factory floor space, it is desirable that bridge 102 and tram 103 be able to work close to walls and other objects. To avoid collisions, accurate position information is necessary.

Figure 1B:
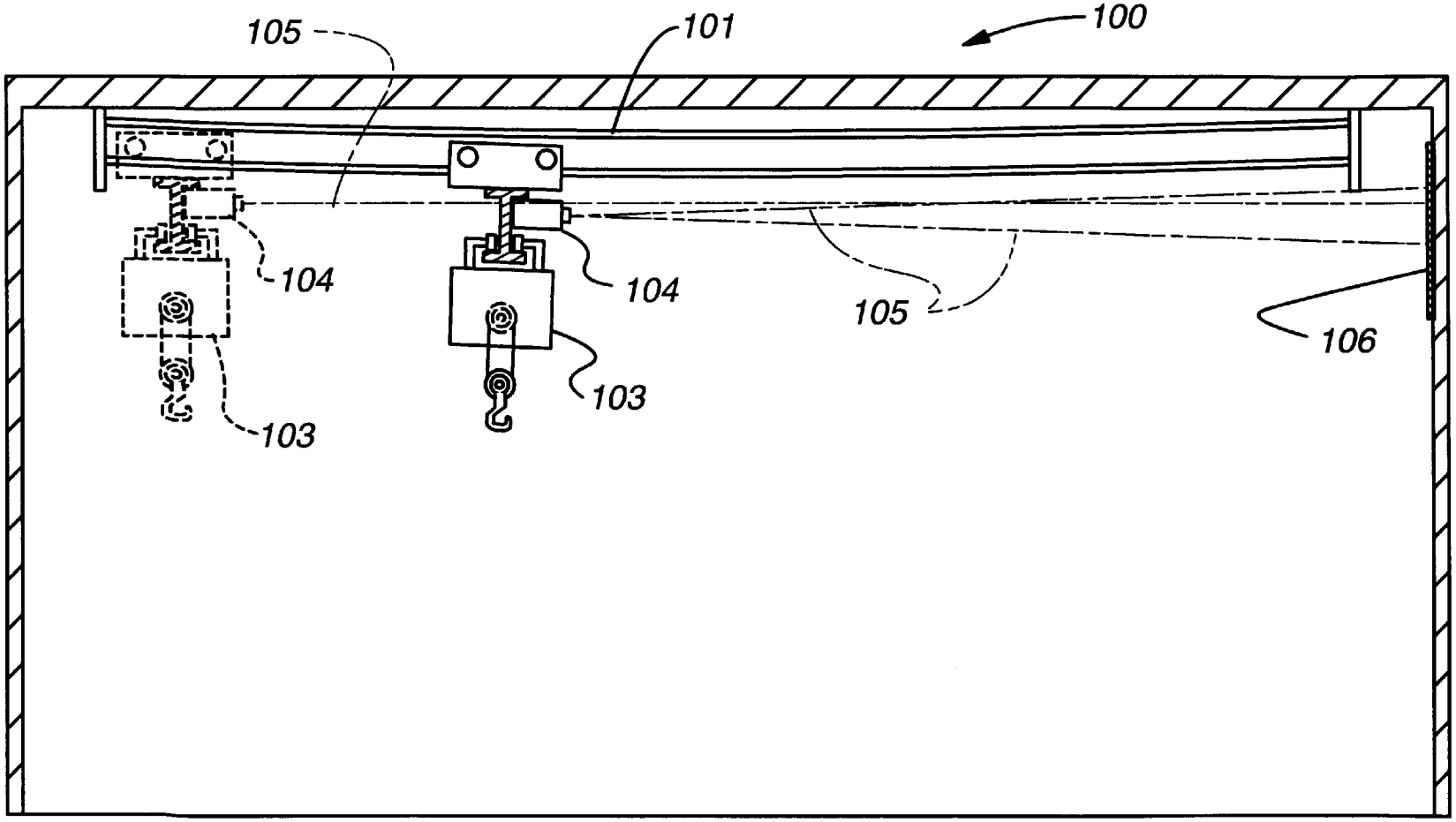
FIG. 1*b* shows a side view of the crane shown in FIG. 1.

In the embodiment shown in FIG. 1*a* and FIG. 1*b*, a position sensor 104 is mounted on bridge 102. Position sensor 104 comprises photoelectric components including a broad beam optical emitter and optical receiver, as well as associated drive, control, and signal conditioning components described in greater detail hereinafter. Position sensor 104 is aimed at a reflective target 106 mounted on a fixed location such as a wall. Axis 105 illustrated as a dashed line in FIG. 1*a* suggests an axis of travel for bridge 102. Position sensor 104 outputs an analog or digital signal indicating position of sensor 104 with respect to reflective target 106.

In a preferred embodiment, position sensor 104 outputs a current signal in the range of four to twenty milliamps that is proportional to the distance between target 106 and sensor 104. It should be understood that any output signal can be generated including voltage, current, optical, acoustic, or the like using available output drive circuitry. It is desirable the sensor 104 output a linear signal, however, non-linear signals and digital signals may be appropriate in particular applications. The four to twenty milliamp output signal of the particular example is used because it is an industry standard and is readily interfaced with other industrial control equipment.

Bridge 102 is illustrated in FIG. 1*a* at a position midway between the span defined by the length of rails 101. When tram 103 is carrying a heavy load, both bridge 102 and rails 101 may bend downward under the load. As a result of bending, at the mid-span position sensor 104 may be in a substantially different horizontal plane as compared to its position at the ends of rails 101 or bridge 102 as shown in FIG. 1*b*. In FIG. 1*b*, bridge 102 and tram 103 are illustrated in phantom at one end of rails 101. Near the end, tram 103 exhibits little skew and points directly at target 106. Near mid span, tram 103 (illustrated in solid lines) bends rail 101 creating significant skew. In the past, laser-based based positioning systems have not been able to compensate for this skew without complex and expensive solutions.

In accordance with the present invention, sensor 104 is designed to output optical energy in a broad beam (indicated by converging dashed lines in FIG. 1*b*) that diverges substantially symmetrically more than two degrees and preferably in the range of three to five degrees as it travels from sensor 104 to target 106. This broad beam ensures that emitted optical energy will reflect from target 106 back to the optical energy detector in sensor 104 within a wide range of skew angles.

Figure 2:
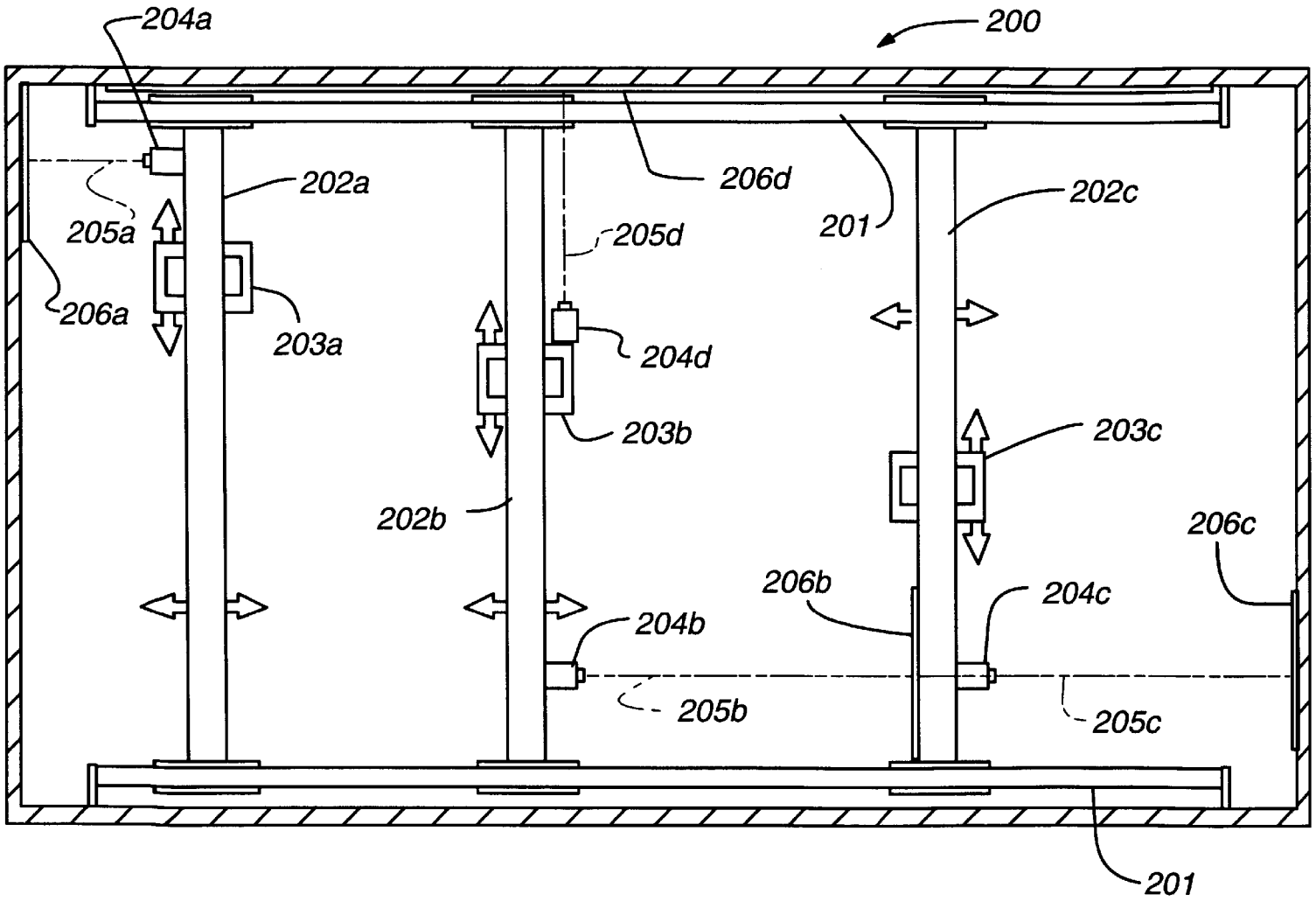
FIG. 2 illustrates a plurality of interacting overhead cranes making multiple uses of position sensors in accordance with the present invention.

FIG. 2 illustrates a second embodiment in which multiple overhead cranes operate and interact within a confined space. When multiple moving objects are present, collision prevention and motion coordination are significant concerns in addition to load control. As seen in FIG. 2, multiple bridges 202*a*–202*c* are mounted on rails 201. Although not illustrated, multiple trams could be mounted to any bridge 202*a*–202*c*. Position sensor 204*c* and target 206*c* operate in a manner similar to the first embodiment to detect and report the position of bridge 202*c* with respect to target 206*c*. Position sensor 204*a* and target 206*a* are used in an analogous fashion to sensor 204*c*, but sense position from an opposite direction illustrating that position sensors in accordance with the present invention can be oriented in multiple directions in a single work environment.

Position sensor 204*b* is aimed at target 206*c* that is mounted on an adjacent bridge 202*c*. Hence, position sensor 204*b* reports relative distance between bridge 202*c* and bridge 202*b*. This information can be used alone or can be coordinated with the output of position sensor 204*c* to determine the absolute position of bridge 202*b* with respect to the wall on which target 206*c* is mounted. Position sensor 204*d* is mounted to tram 203*b* and reports position of tram

203*b* on bridge 202*b*. Position sensor 204*d* illustrates a manner in which the present invention is employed to detect position in multiple, non-parallel axes in a single work space.

In the embodiments shown in FIG. 1*a*, FIG. 1*b* and FIG. 2, the position sensors desirably emit optical energy having high energy with a symmetrical beam width wider than practically attainable using conventional laser devices. Although a laser diode can be set for a broad beam, the beam will have a 3:1 asymmetry unless very costly optics are used. An example of a device suitable for use in the present invention is an infrared light emitting diode (LED) (e.g., LED 401 shown in FIG. 4) that emits non-coherent optical energy in a symmetric diverging pattern as it leaves the LED. In a particular example an HDSL-4220 having a thirty degree viewing angle or an HDSL-4230 having a seventeen degree viewing angle. Both of these LED devices are available from Hewlett Packard Company. An advantage of LED devices as replacements for lasers diodes is not only in the comparatively large viewing angle, but also in cost.

Because of the low conversion efficiency of LEDs, it has been believed that they were not suitable to emit sufficient power to be reflected and received over the significant distances involved in an industrial work space. The present invention involves a drive technique that causes the LED to emit significant power for a short duty cycle such that junction temperature in the LED remains within the devices safe operating area to ensure long term reliability. In a specific circuit tested, an HDSL-4230 device is pulsed briefly (e.g., 20 ns) with a 200 volt power supply resulting in an instantaneous power output in the range of 7 to 12 microwatts. The LED is pulsed at 125 Hz allowing the LED junction to cool sufficiently between pulses.

In the preferred embodiment, optical energy emitted by the LED is passed through a lens that focuses the beam to achieve a desired three to five degree divergence as it exits position sensor 104. The lens materials and optical design are widely available and can be modified significantly to meet the needs of a particular application.

In order to return sufficient energy to the photodetector in position sensor 104, reflective target 106 must be highly reflective. A suitable reflective material is diamond grade reflector film available from Minnesota Mining and Manufacturing Company (3M). This film is specified to reflect 90% of the optical energy reaching its surface which is acceptable performance for overhead crane spans in the hundreds of feet.

Figure 3:
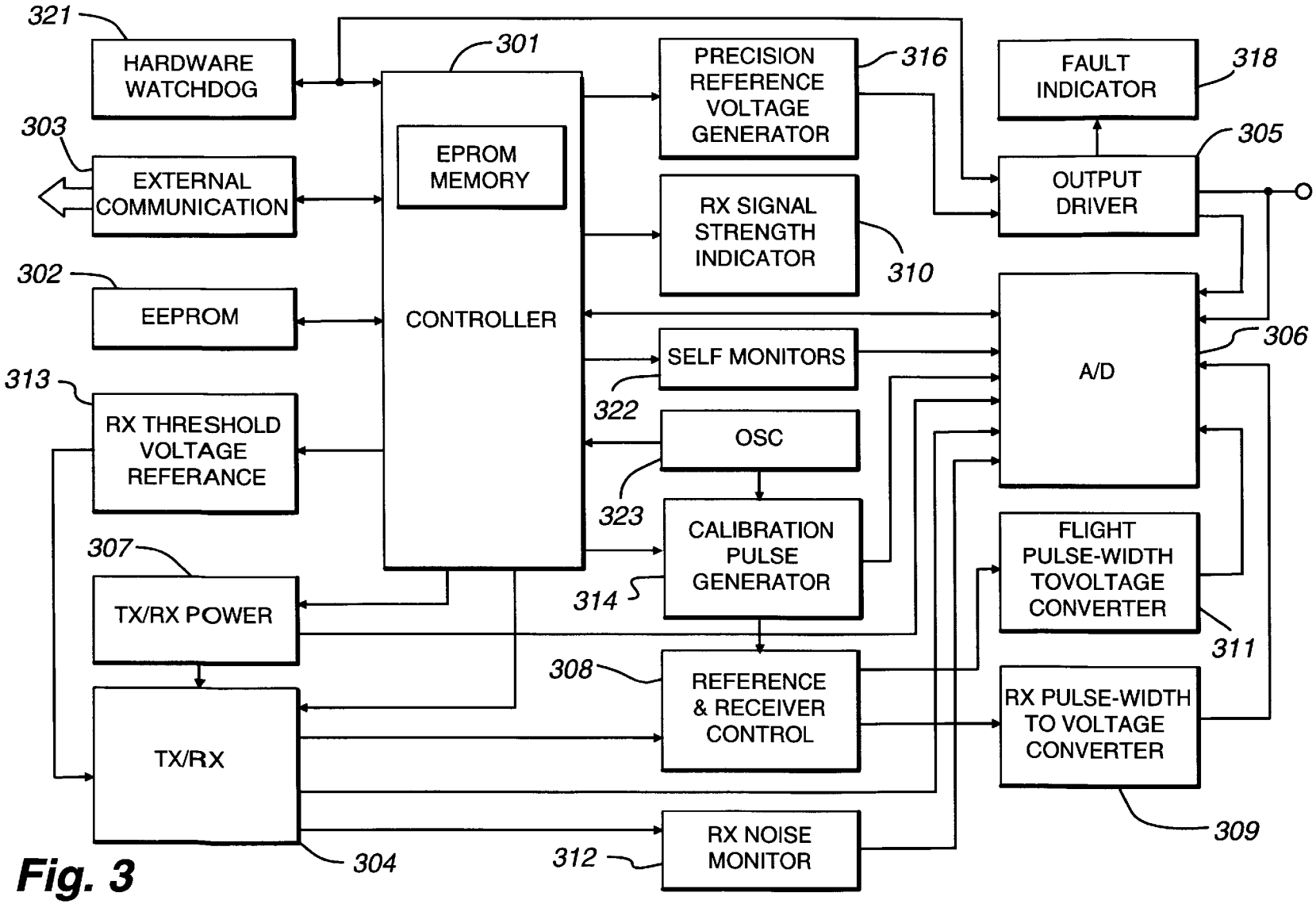
FIG. 3 shows a block diagram of an exemplary embodiment of an industrial position sensor in accordance with the present invention.

FIG. 3 illustrates in block diagram form major components or functional units of the drive, control, and signal conditioning components of position sensor 104 shown in FIG. 1 and 204*a–d* shown in FIG. 2. In FIG. 3 arrows indicate direction of communication with bi-directional arrows indicating bi-directional communication. Controller 301 is a programmable controller capable of executing instructions stored in a program memory.

Controller 301 includes multiple data input/output (I/O) ports as well as control ports for receiving external oscillator 323, clock signals or external control signals. A suitable device is a 87C51 family microcontroller available from Intel Corporation. External support components such as power supplies and oscillators are not shown in FIG. 1 for ease of illustration and understanding. Oscillator 323 shown in FIG. 3 is used to provide a reference time base for time base calibration.

Preferably, controller 301 communicates with external equipment via external communications circuit 303 that enables bi-directional serial and/or parallel communication with controller 301. External communication component 303 is used for functions such as programming controller 301 as well as monitoring controller 301 and other components coupled to controller 301. External communications component 303 also serves to facilitate position sensor calibration.

In operation, transmit/receive circuit 304 (labeled TX/RX in FIG. 3) comprises the photoelectric elements necessary to emit and receive optical energy. In response to control signals from controller 301, TX/RX circuit 304 emits a timed pulse optical energy and detects a reflected pulse from reflective target 106 in FIG. 1. TX/RX circuit 304 generates a plurality of output signals that are then received and coupled through components described hereinbelow to analog-to-digital (A/D) converter 306.

In general, the specific example described herein uses A/D converter 306 to convert analog signals to digital binary signals. The digital signals are selectively coupled to controller 301 in response to control signals generated by controller 301. A/D converter 306 preferably comprises multiple analog input ports and one or more bi-directional output ports to support communication with controller 301. An example device suitable for A/D converter 306 is part number TLC1543 available from Texas Instruments, Inc.

Figure 4:
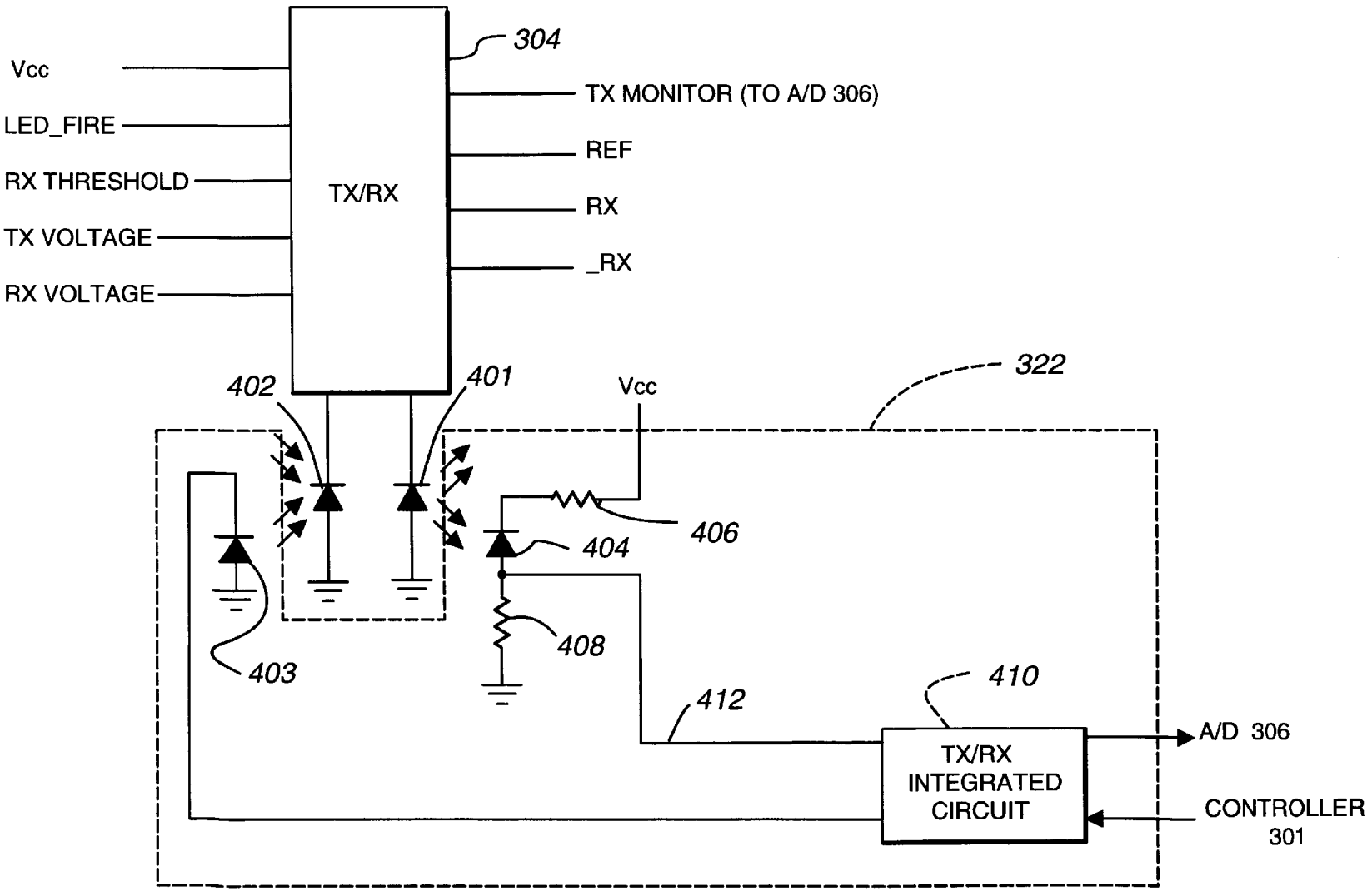
FIG. 4 shows in block diagram form a transmit and receive unit shown in FIG. 3.

As shown in FIG. 4, TX/RX circuit 304 is powered by a voltage supply on the PWR line such as VCC that powers logic devices in TX/RX circuit 304. TX/RX circuit 304 is also coupled to receive power from TX/RX power circuit 307. In accordance with the present invention, the optical energy transmitter is implemented by LED 401 and is powered by a brief high voltage impulse from TX/RX power component 307. A suitable component for receiver photodiode 402 is an SFH203PFA available from Siemens, Inc., among other suppliers.

TX/RX power component 307 also supplies a high voltage to receiver photodiode 402. As used herein, the term "high voltage" means higher than normally available VCC. The voltage supplied to photodiode 402 is selected to set the photodetector sensitivity at a level sufficient to reliably receive the reflected signal from target 106 in FIG. 1. In the particular example, TX/RX power component 307 supplies 40V to TX/RX unit 304 to power photodiode 402. The photodetector is enabled whenever the TX/RX high voltage unit 307 is enabled, which is most of the time.

TX/RX unit 304 receives an LED_FIRE control signal that causes LED 401 to fire or emit optical energy. The RX THRESHOLD control signal is an analog voltage signal used to compensate for optical energy noise in the work space. The RX THRESHOLD signal is generated by monitoring the received signal from TX/RX unit 304 and integrating or accumulating the signal in RX noise monitor 312 during time periods when LED 401 is inactive. The accumulated voltage indicates the optical energy noise level and is communicated to controller 302 via A/D converter 306. Controller 301 generates a pulse-width modulated signal (PWM) to RX threshold voltage reference 313 in response to the signal from A/D converter 306. The analog output voltage of voltage reference 313 is the RX THRESHOLD control signal shown in FIG. 4.

Using, for example, a comparator circuit, the output of photodiode 402 is compared to RX THRESHOLD to generate a pulse (i.e., the RX signal) during a time when the power of the received optical energy is greater than a device-dependent threshold power. Preferably, the comparator has differential outputs to provide RX and _RX signals.

Hence, the pulse width of the RX and _RX signals is determined by the magnitude of the received optical energy. Equivalently, a single, non-differential, output can be generated by TX RX circuit 304. Where only one signal is used from the TX/RX (_RX or RX), the complement is generated in controller 301 with an inverter.

Self-monitor circuit 322 desirably includes integrity verification circuits that monitor items such as TX bias voltage and functionality of the TX and RX diodes. TX bias voltage can be monitored to generate an analog or digital signal indicating the actual value of the TX bias voltage or an indication of when the TX bias voltage is out of range. In the specific example of FIG. 3, an analog signal is generated using a resistive divider and is coupled to A/D circuit 306 for processing.

In a particular example self-monitor circuit 322 also includes a photodiode 404 shown in FIG. 4 that is optically coupled to LED 401 so as to receive optical energy when LED 401 is fired. In FIG. 4, photodiode 404 is coupled to Vcc through resistor 406 and to ground through resistor 408. The state of photodiode 404 is monitored by the signal on line 412. LED 401 can be fired by controller 301 via signals to TX/RX circuit 304 while the signal on line 412 is monitored to verify that LED 401 has indeed fired. TX/RX integrity circuit provides appropriate signal conditioning to the RX LED ON signal and applies the signal to A/D converter 306. In this manner, if integrity of LED 401 is compromised by damage, device failure, or the like, controller 301 is notified and can take appropriate action.

Likewise, self-monitor circuit 322 preferably includes an LED 403 shown in FIG. 4 that is optically coupled to photodetector 402 so that photodetector 402 receives optical energy when LED 403 is fired. LED 403 is fired by controller 301 via signal conditioning circuitry in TX/RX integrity circuit 410. The state of photodiode 402 is monitored controller 301 via TX/RX circuit 304. LED 403 can be fired by controller 301 while the state of photodiode 402 is monitored to verify that photodiode 402 is functional. In this manner, if integrity of photodiode 402 is compromised by damage, device failure, or the like, controller 301 is notified and can take appropriate action.

Additionally, functionality of TX/RX circuit 304 may be monitored by, for example, measuring the reverse voltage of LED 401 and/or 402, or by indicating the result of more complex diagnostics performed within TX/RX circuit 304.

Figure 5:
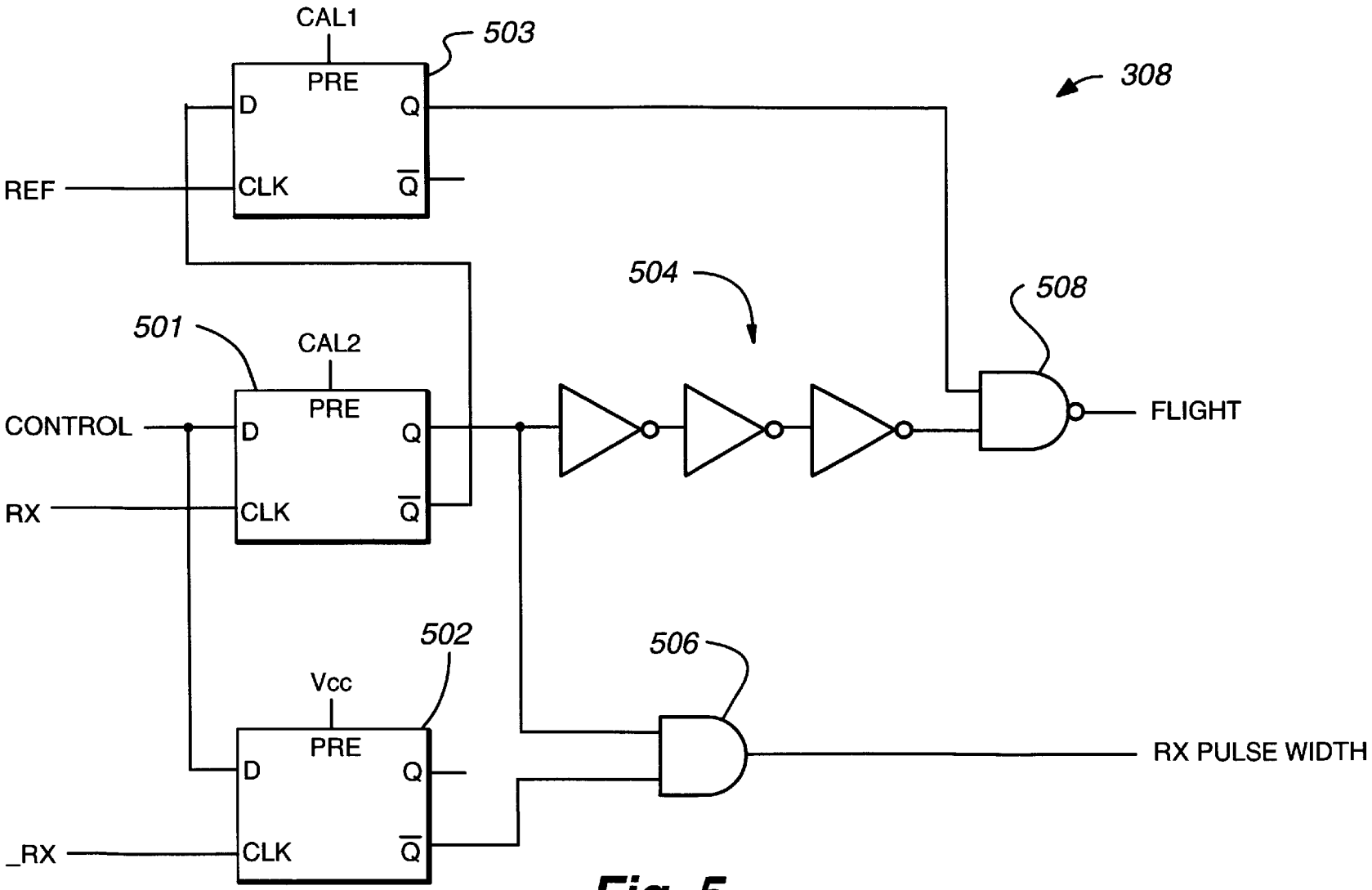
FIG. 5 shows in block diagram form a receiver control circuit shown in FIG. 3.

Reference and receiver control 308, shown in greater detail in FIG. 5, receives the RX and/or the _RX signal as well as REF signals. Reference and receiver control circuit 308 acts as an input buffer to latch the differential RX and _RX signals so as to indicate both the leading edge of the received optical energy pulse and the trailing edge. As shown in FIG. 5, reference and receiver control circuit 308 uses edge-triggered D-type flip flops 501 and 502 having clock inputs coupled to receive the RX and _RX signals, respectively. The data inputs of flip flops 501 and 502 are coupled to a control signal supplied by controller 301 (shown in FIG. 3) In a "ready" state (i.e., awaiting reception of the RX and _RX signals) flip flops 501 and 502 are set such that the Q output of flip flop 501 is a logic LOW and the _Q output of flip flop 502 is a logic HIGH. In the ready state, the RX PULSE WIDTH output signal from AND gate 506 is a logic LOW. The ready state is established by appropriate assertion of CLEAR signal to flip flops 501, 502, and 503 by control circuit 301 (not shown).

The rising edge of the RX signal indicates the beginning of the received optical energy pulse, and latches the logic HIGH signal on the Q output of flip flop 501. The output value on the _Q output of flip flop 502 does not change at this time because the rising edge of RX corresponds to a falling edge of the _RX signal that will not trigger the clock on flip flop 502. When the Q output of flip flop 501 changes to a logic high, the output of AND gate 506 changes to a logic HIGH. At the end of the received pulse, the RX signal transitions from LOW to HIGH causing flip flop 502 to latch a logic LOW on the _Q output. This in turn causes the output of AND gate 506 to return to a logic LOW. In this manner, reference and receiver control circuit 308 outputs the RX PULSE WIDTH signal having a duration indicating pulse width of the received optical energy.

The specific logic devices and logic polarities described herein are provided as an example only, and it is straightforward to realize the functionality described herein with any available logic technology by appropriate modifications. For example, in practice, AND gate 506 may be implemented with a NAND gate with an inverter coupled in series with its output to provide a more efficient integrated circuit implementation. Moreover, the RX and _RX signals are interchangeable with appropriate inversion that may be desirable to provide more signal buffering and greater input impedance to reference and receiver control circuit 308.

Reference and receiver control circuit 308 also includes flip flop 503 having a clock input coupled to receive the REF signal that indicates when LED 401 (shown in FIG. 4) fires. The _Q output of flip flop 501 is coupled to the data input of flip flop 503. In the ready state, the Q output of flip flop 503 is a logic LOW and the _Q output of flip flop 501 is a logic HIGH that causes the FLIGHT signal generated by NAND gate 508 to be a logic HIGH. Upon a positive going transition of the REF signal (which inherently occurs before the RX or _RX signals change state) the logic HIGH on the data input of flip flop 503 is transferred to the Q output of flip flop 503 to an input of NAND gate 508. In response, the output of NAND gate 508 transitions from logic HIGH to logic LOW. As set out hereinbefore, at the leading edge of the received optical energy pulse, the Q output of flip flop 501 changes to a logic HIGH. This transition causes the FLIGHT signal output by NAND gate 508 (as observed at the output of delay elements 504) to return to a logic HIGH. In this manner, reference and receiver control circuit 308 generates the FLIGHT signal indicating the time elapsed between emission of optical energy by LED 401 and reception of optical energy by LED 402.

The RX PULSE WIDTH output of reference and receiver control circuit 308 is coupled to RX pulse width-to-voltage converter 309. Pulse width-to-voltage converter 309 is essentially an integrator or accumulator that generates an analog output voltage that indicates pulse width of the RX PULSE width signal. The analog output of pulse width-to-voltage converter 309 is coupled to A/D converter 306 and in turn coupled to controller 301 when requested. Because pulse width of the received signal indicates received power, the analog output of RX pulse-width-to-voltage converter 309 indicates receive power. A/D converter 306 couples this received power information to controller 301.

In response to the digital signal from A/D converter 306 corresponding to the analog output from reference and receiver control circuit 308, controller 301 generates a frequency modulated signal to signal strength indicator 310. In the preferred embodiment indicator 310 is realized by an LED that emits a visible indication to an operator in response to the frequency modulated output of controller 301. In other words, indicator 301 flashes at a rate that indicates the output of RX pulse-width-to-voltage converter 309 and so indicates magnitude of optical energy received by photodiode 402.

In a preferred embodiment, controller 301 is programmed to vary the flashing rate of signal strength indicator 310 from one to about forty pulses per second as an indication of received power. The upper end of the preferred range is chosen simply because any faster pulse rate will not be visible to most operators. At forty pulses per second signal strength indicator 310 will appear to be continuously on, but will require less power than if it were in fact turned on continuously.

An important feature of signal strength indictor 310 is that it significantly simplifies set up and alignment of position sensor 104 (shown in FIG. 1). Typically, alignment is best performed by positioning position sensor 104 about midway along the span defined by rails 102. An operator can coarsely align position sensor 104 by aiming optical emitter 401 and optical detector 402 at reflective target 106. The operator can accomplish fine alignment by adjusting the position of position sensor 104 while viewing signal strength indicator 310. When signal strength indicator 310 indicates adequate alignment by an apparently continuous signal, the operator can rigidly affix position sensor 104 to bridge 102 (or another motorized vehicle).

Returning to FIG. 3., flight pulse width-to-voltage converter 311 can be implemented as an integrator or accumulator that generates an analog output voltage indicating pulse width of the Flight signal. The analog output voltage from pulse-width-to-voltage converter 311 is converted to a digital signal by A/D converter 306 and coupled to controller 301 upon request.

RX noise monitor 312 is coupled to either the RX or _RX signal lines and functions as a low pass filter and accumulator to generate an analog output voltage indicating background, low frequency noise superimposed on the received signal. In an industrial environment, it is likely that significant optical background energy exists in the frequencies to which photodiode 402 is sensitive. RX noise monitor circuit 312 generates an analog signal indicating this noise and is coupled to A/D converter 306. In this manner, controller 301 can sample the analog voltage indicating background noise as often as desired, and generate a control signal to RX threshold voltage reference 313. In a particular example, controller 301 generates a PWM signal in response to the analog voltage generated by RX noise monitor 312. RX threshold voltage reference 313 accumulates or integrates the PWM output from controller 301 to generate a RX THRESHOLD signal (shown also in FIG. 4) to TX/RX circuit 304.

Figure 6:
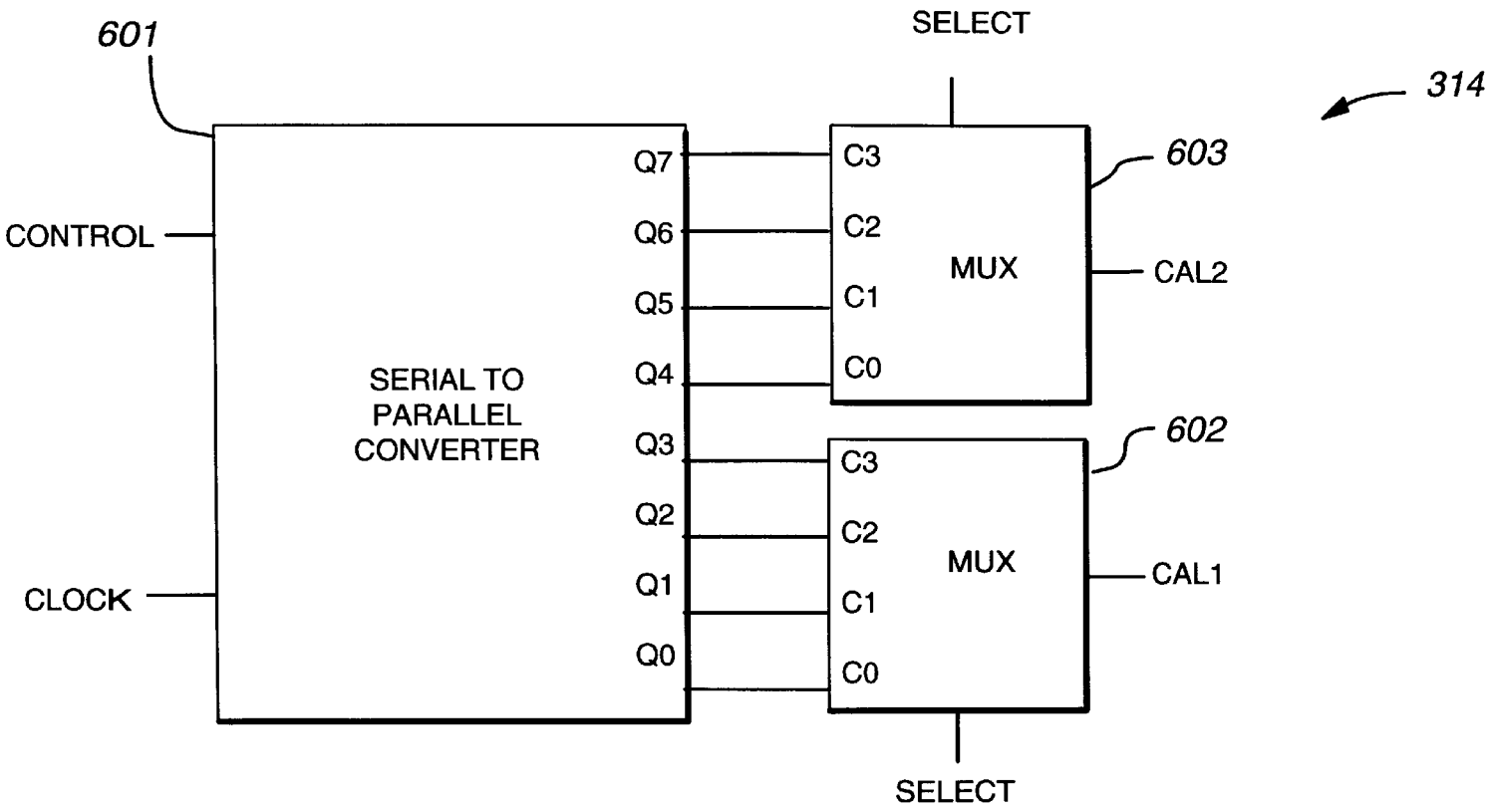
FIG. 6 shows in block diagram form a calibration pulse generator shown in FIG. 3.

Reference and receiver control circuit 308 (shown in FIG. 5) also receives CAL1 and CAL 2 calibration signals from calibration pulse generator 314 shown in FIG. 6. The CAL1 signal is coupled to the PRESET input of flip flop 503. When the CAL1 signal is asserted, the Q output of flip flop 503 is forced to a logic HIGH thereby simulating reception of the REF signal. Similarly, when CAL2 is asserted, the Q output of flip flop 501 is forced to a logic HIGH thereby simulating a rising edge of the RX signal (i.e., the leading edge of a received optical energy pulse). The CAL1 and CAL2 signals are used for calibration purposes to measure the response of reference and receiver control circuit 308 as component performance drifts and changes over time and temperature.

Preferably, as part of each cycle CAL1 and CAL2 pulses generated at 1, 4, and 5 clock intervals to generate a three point calibration curve. CAL pulses of 1, 3, 4 & 5 clock intervals can be generated for various 2 & 3 point CAL curves. FIG. 6 illustrates an example circuit used to generate the CAL1 and CAL2 pulses. A control signal asserted by controller 301 (shown in FIG. 3) is sequentially passed through the parallel outputs Q0–Q7 of an eight bit serial to parallel converter 601 upon reception of each clock pulse. The clock signal may be a system clock, a local oscillator, or may be generated by any convenient means including by controller 301. An accurate time base is required for accurate measurements.

In the particular configuration shown in FIG. 6, when the control signal is clocked to the Q1 output, all of the inputs to multiplexor (MUX) 602 are asserted. Because all of the inputs to MUX 602 are coupled in parallel, the output of MUX 602 is asserted regardless of the state of the SELECT signals. Hence at one clock period after assertion of the CONTROL signal, CAL1 is asserted simulating the REF signal shown in FIG. 5.

MUX 603 selects one of the inputs C0–C3 based upon state of the SELECT signals. The SELECT signals are programmably generated by controller 301 to select the desired duration between the CAL1 and CAL2 signals. In the particular example, C0 of MUX 603 is coupled to the Q2 output of serial to parallel converter 601. Hence, if the SELECT signals are chosen to couple C0 to the output of MUX 603, CAL 2 will be asserted one clock period after the CAL1 signal. Similarly, C2, C3, and C4 of MUX 603 are coupled to the Q4, Q5, and Q6 outputs, respectively. In this manner, by appropriate assertion of the SELECT signals, CAL2 will be asserted at either 1, 3, 4, or 5 clock periods after the CAL1 signal is asserted. The number of clock cycles chosen for the CAL1 and CAL2 signals is a matter of design choice to meet the needs of a particular application and can be implemented in a wide variety of equivalent circuitry.

Figure 7:
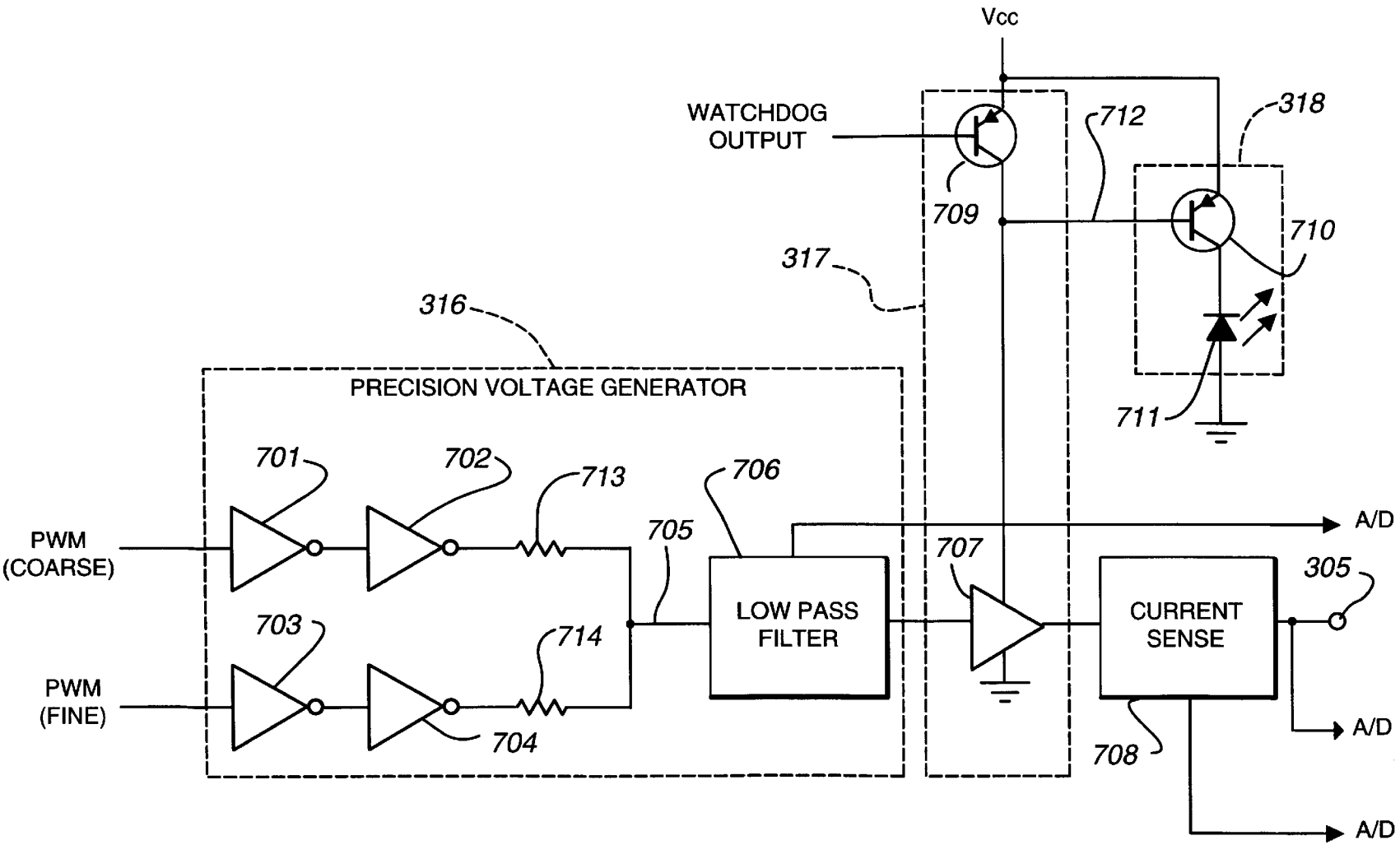
FIG. 7 shows in block diagram form a precision voltage generator and output driver shown in FIG. 3.

As shown in FIG. 3, the output signal is provided by an output driver 317 that is controlled by a signal from precision voltage reference generator 316. FIG. 7 show the components of a specific example of precision voltage generator 316, output driver 317, and fault indicator 318 in greater detail. To provide a desired precision, the specific embodiment a voltage generator 316 with sixteen bits of precision. A voltage generator with sixteen bit precision could be implemented using a sixteen bit microcontroller for controller 301. However, sixteen bit microcontrollers are expensive, hence are prohibitive to use to realize controller 301.

In the specific embodiment, controller 301 is an eight bit microcontroller and so can be readily programmed to generate an eight bit precision PWM output. In accordance with the present invention, controller 301 is programmed to supply two PWM outputs indicated by PWM (COURSE) and PWM (FINE) in FIG. 7. PWM (COURSE) is coupled through buffers 701 and 702 resistor 713 to summing node 705. PWM (FINE) is coupled through buffers 703 and 714 resistor 714 to summing node 705. Resistors 713 and 714 are selected to have a ratio of $R:2^N R$ where N is the number of bits of precision in PWM (FINE). Hence, N is eight in the specific example and the ratio of resistor 714 to resistor 713 is 256:1.

The signal coupled to summing node 705 from PWM (FINE) is a precise fraction of the signal coupled to summing node 705 from PWM (COURSE). Summing node 705 is coupled to low pass filter 706 that serves to convert the charge signal on summing node 705 into an analog output voltage coupled to output amplifier 707. Precision voltage generator 316 essentially acts as a PWM-to-analog voltage converter using an R:$2^N$R resistive ladder to increase the precision. Any number of PWM signals can be combined in this manner to increase the precision of precision voltage generator 316 by appropriate selection of ladder resistors.

Output amplifier 707 generates an output signal, such as a current signal, that is proportional to the analog voltage driven by precision voltage generator 316. In the specific embodiment, output current provided to the load at output node 305 is monitored by current sense circuit 708 that is coupled to A/D converter 306. Likewise, the voltage on output node 305 is monitor by coupling to A/D converter 306.

The software watchdog timer generates a microcontroller reset if approximately 20 milliseconds has elapsed without reloading the watchdog's compare register. The hardware watchdog (the short one) needs to time out then be triggered again to continually retrigger the long hardware watchdog.

Output amplifier 707 and buffers 701 through 704 are coupled to a power supply such as VCC through control transistor 709. Control transistor 709 is responsive to one or more hardware and/or software watchdog circuits 321 (shown in FIG. 3). In the preferred embodiment, the software watchdog timer generates a reset signal to controller 301 when approximately 20 milliseconds has elapsed without reloading the watchdog's compare register. A first hardware watchdog must time out then be triggered again to continually re-trigger a second hardware watchdog. In a particular example, the first hardware watchdog times out with a period of approximately 40 milliseconds. The specific timings are given by way of example; it is to be understood that the watchdog timing can be modified to meet the needs of a particular application. The outputs of each of the watchdog circuits are coupled together to drive control transistor 709.

When any of the watchdog circuits fail to retrigger, transistor 709 de-couples output amplifier 707 from the power supply VCC, preventing any current output at node 305. Activation of transistor 709 also pulls node 712 to a logic LOW, activating transistor 710 in fault indicator circuit 318. When transistor 710 is activated, indicator LED 711 is turned on to indicate the fault condition to the operator. In the preferred embodiment, low pass filter 706 is also coupled to the power supply VCC through transistor 709 and so also is inactivated in response to the watchdog signal. Deactivation of low pass filter 706 removes any input signal from output amplifier 317.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A spatial positioning system for determining the linear position of a movable object along a selected axis, comprising:

a target positioned at a location aligned with the selected axis;

a broad beam optical energy emitter mounted on the movable object and directed at the target;

an optical energy receiver mounted on the movable object and aligned to receive optical energy reflected by the target, the optical energy detector generating a receive signal indicating reception of the optical energy;

a time of flight circuit coupled to the emitter and receiver and generating a flight time signal indicating the elapsed time from emission of the optical energy to reception of reflected optical energy; and a control circuit coupled to monitor the flight time signal and output a position signal indicating position of the movable object with respect to the target wherein the receive signal comprises a first signal indicating when the received power is greater than a preselected threshold and a second signal delayed from the first signal by an amount indicating the power of the received signal.

2. A spatial positioning system for determining the linear position of a movable object along a selected axis, comprising:

a target positioned at a location aligned with the selected axis;

a broad beam optical energy emitter mounted on the movable object and directed at the target;

an optical energy receiver mounted on the movable object and aligned to receive optical energy reflected by the target, the optical energy detector generating a receive signal indicating reception of the optical energy;

a time of flight circuit coupled to the emitter and receiver and generating a flight time signal indicating the elapsed time from emission of the optical energy to reception of reflected optical energy; and a control circuit coupled to monitor the flight time signal and output a position signal indicating position of the movable object with respect to the target, said system further comprising:

integrity monitoring circuitry optically coupled to the optical energy receiver and generating optical energy, wherein the optical energy receiver indicates optical energy received from the integrity monitor.

3. A spatial positioning system for determining the linear position of a movable object along a selected axis, comprising:

a target positioned at a location aligned with the selected axis;

a broad beam optical energy emitter mounted on the movable object and directed at the target;

an optical energy receiver mounted on the movable object and aligned to receive optical energy reflected by the target, the optical energy detector generating a receive signal indicating reception of the optical energy;

a time of flight circuit coupled to the emitter and receiver and generating a flight time signal indicating the elapsed time from emission of the optical energy to reception of reflected optical energy; and a control circuit coupled to monitor the flight time signal and output a position signal indicating position of the movable object with respect to the target wherein the receiver receives a signal comprising the reflected signal superimposed on optical energy background noise and the circuit further comprises:

a programmable reference voltage generator programmed to output a reference voltage indicating the background noise level, wherein the optical energy receiver generates the receive signal only after the power of the received optical energy is greater than the reference voltage.

4. A spatial positioning system for determining the linear position of a movable object along a selected axis, comprising:

a target positioned at a location aligned with the selected axis;

a broad beam optical energy emitter mounted on the movable object and directed at the target;

an optical energy receiver mounted on the movable object and aligned to receive optical energy reflected by the target, the optical energy detector generating a receive signal indicating reception of the optical energy;

a time of flight circuit coupled to the emitter and receiver and generating a flight time signal indicating the elapsed time from emission of the optical energy to reception of reflected optical energy; and a control circuit coupled to monitor the flight time signal and output a position signal indicating position of the movable object with respect to the target wherein the position signal comprises a plurality of pulse width modulated (PWM) signals and the system further comprises:

a weighting network having inputs coupled to receive each of the PWM signals from the controller and having an output generating a signal comprising a weighted combination of the PWM signals;

an low pass filter coupled to the output of the weighting network and generating a voltage signal indicating position of the movable object with respect to the target.

5. A method for operating a spatial positioning system for determining the linear position of a movable object along a selected axis wherein the movable object is an overhead crane moving along rails defining a fixed span comprising the steps of:

mounting a reflective target at a location on the selected axis;

providing an optical energy emitter adjustably mounted on the movable object;

providing an optical energy receiver adjustably mounted on the movable target;

aiming the optical energy emitter at the target;

monitoring the power received by the optical energy receiver while adjusting the alignment; and rigidly fixing the emitter and receiver to the movable object when the power received is above a preselected threshold, further comprising the step of positioning the movable object midway through the fixed span before the step of aiming the emitter at the target.

6. A spatial positioning system for determining a position of a movable object, comprising:

a target positioned at a reference location;

a first optical energy emitter mounted on the movable object and directed at the target;

a first optical energy receiver mounted on the movable object and aligned to receive optical energy reflected by the target, the first optical energy receiver generating a receive signal indicating reception of the optical energy;

a second optical energy emitter optically coupled with the first optical energy receiver;

a second optical energy receiver optically coupled with the first optical energy emitter, the second optical energy receiver generating a receive signal indicating reception of optical energy from the first optical energy emitter; and an integrity monitor generating stimulus signals to the first and second optical energy emitters and monitoring the response of the first and second optical energy receivers to detect failure of either the first optical energy receiver or the first optical energy emitter.

* * * * *